United States Patent [19]

Molins

[11] 4,103,596

[45] Aug. 1, 1978

[54] APPARATUS FOR FEEDING AND CUTTING CIGARETTE FILTER WRAPPER MATERIAL

[75] Inventor: Desmond Walter Molins, London, England

[73] Assignee: Molins Limited, England

[21] Appl. No.: 808,366

[22] Filed: Jun. 20, 1977

[30] Foreign Application Priority Data

Jun. 19, 1976 [GB] United Kingdom ..... 25561/76

[51] Int. Cl.[2] ..... A24C 5/50

[52] U.S. Cl. ..... 93/77 FT; 83/107; 83/408

[58] Field of Search ..... 93/77 FT, 1 C, 81 R; 83/102, 107, 408

[56] References Cited

U.S. PATENT DOCUMENTS

| | | | |
|---|---|---|---|
| 1,810,677 | 6/1931 | Pfeiffer | 83/102 X |
| 2,882,970 | 4/1959 | Schur | 93/77 FT X |
| 3,199,418 | 8/1965 | Schubert | 93/1 C |
| 3,372,702 | 3/1968 | Bohn et al. | 93/1 C X |
| 3,779,849 | 12/1973 | Beard et al. | 93/1 C X |
| 3,875,837 | 4/1975 | Dussaud | 83/408 X |

*Primary Examiner*—James F. Coan

*Attorney, Agent, or Firm*—Craig & Antonelli

[57] ABSTRACT

Wrapper portions, principally for use as uniting bands for joining together groups of component filter portions to form a composite filter rod, are obtained by longitudinally slitting a web, supporting the resultant strips on a plurality of suction tapes, guiding the tapes around angled pulleys to space them apart for delivery to a suction rolling drum, and cutting the strips into portions on the drum.

14 Claims, 12 Drawing Figures

Figure 1:
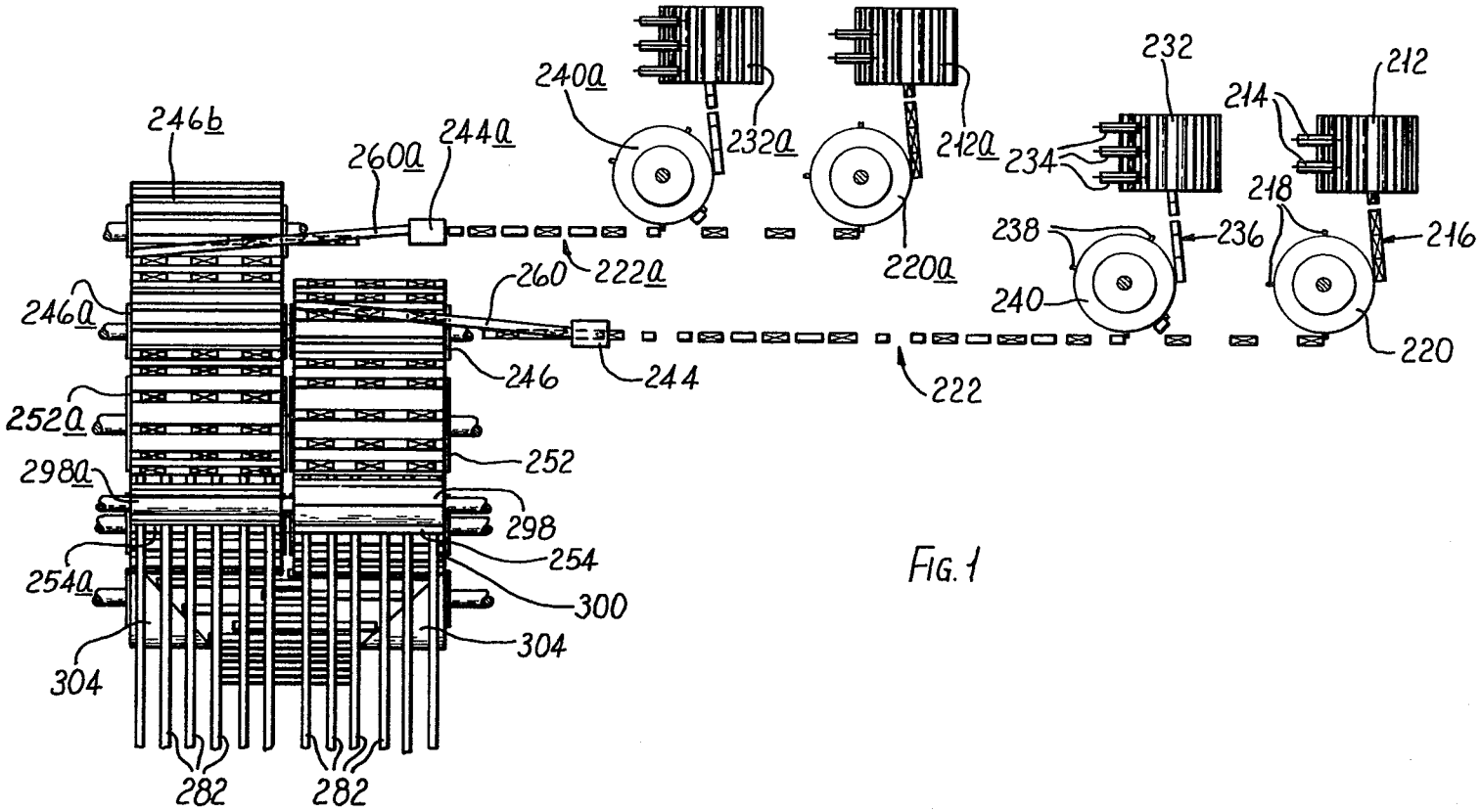

IVA
IVA
IVB
IVB
260
222
262
264

260
262
246

266
260
262
264
222

266
260
262
264
222

292
294
284
284
292
294

282
296
278
284

APPARATUS FOR FEEDING AND CUTTING CIGARETTE FILTER WRAPPER MATERIAL

This invention relates to apparatus for feeding wrapper material. The apparatus may form part of a machine for forming composite filter rods, from which composite filters, for incorporation in filter cigarettes, can be obtained by cutting the rods at appropriate positions.

It is common for cigarettes to consist of a tobacco filler portion and an adjoining mouthpiece portion. Cigarettes of this type are commonly referred to as "filter cigarettes" and mouthpieces are referred to as "filters"; however, a mouthpiece or part of a mouthpiece could comprise a tube.

Composite filters are known in which each filter comprises at least two axially adjacent portions of different filter material. For example, a common construction of a composite (dual) filter has a portion consisting of a prewrapped plug of paper-like material and a portion consisting of a tow of cellulose acetate fibres or other suitable fibrous material.

It is already known to form a composite filter rod by assembling filter portions of different materials in an alternating stream and continuously feeding the stream into the garniture of a continuous rod filter making machine where it is enclosed in a continuous wrapper web. It is also known to assemble alternating filter portions in aligned groups which are conveyed transversely to their lengths and a precut piece of wrapper material rolled and sealed around the whole length of each group to form a composite filter rod.

Our copending U.S. Patent Application No. 672,148 the disclosure of which is hereby incorporated herein in full, describes a method including the steps of conveying a group of axially aligned rod-like articles transverse to its length, feeding a web of uniting material, continuously longitudinally slitting the web into a plurality of strips, feeding the strips around guide elements which are spaced in relation to the directions of travel of the strips so that said directions of travel are changed and said strips are spaced laterally apart, transversely cutting each strip into portions to provide a plurality of uniting bands, and wrapping and sealing a uniting band around the adjacent end portions of each adjacent pair of rod-like articles in a group. The present invention is concerned with another way of feeding wrapper material, which can be used to unite groups of rod-like articles.

According to the present invention apparatus for feeding wrapper material comprises means for feeding a web of material, means for continuously longitudinally slitting the web into a number of strips, at least two endless bands arranged so that each strip may be supported by a band between a first region of the band path and a second region of said path, guide means for the bands to cause the bands to travel in adjacent paths in said first region and in laterally spaced paths in said second region, and means for receiving laterally spaced strips from the bands in said second region.

The endless bands are preferably substantially parallel in the first region and in the second region. Preferably each strip is supported by a different band. The slitting means may be arranged adjacent said first region so that the web is cut into strips whilst supported by the bands. The bands may be driven and may have suction applied through them to hold the strips. The guide means may include angularly-disposed pulleys arranged between the first and second regions. In this case, since the bands leaving the pulleys will not be coplanar, they may be twisted so that they become coplanar at the receiving means.

The receiving means may include at least one rotatable drum and means for cutting the strips into portions on the drum. The drum may be associated with a rolling plate and may receive groups of rod-like articles, e.g. component filter portions, so that the cut strip portions are rolled around the adjacent ends of the articles to unite the group into a composite rod.

The present apparatus for feeding wrapper material can also be used for feeding foil for wrapping bundles of cigarettes. For example, where cigarettes are moved on twin parallel tracks in a cigarette packing machine it is convenient to feed foil for wrapping the bundles from a double-width web and then to slit the web and guide each strip so produced to cutting and feeding means associated with each of the tracks. The guide means would then take the form of angularly-disposed drums, to which suction is applied to control the foil strips through air-pervious endless bands.

Figure 2:
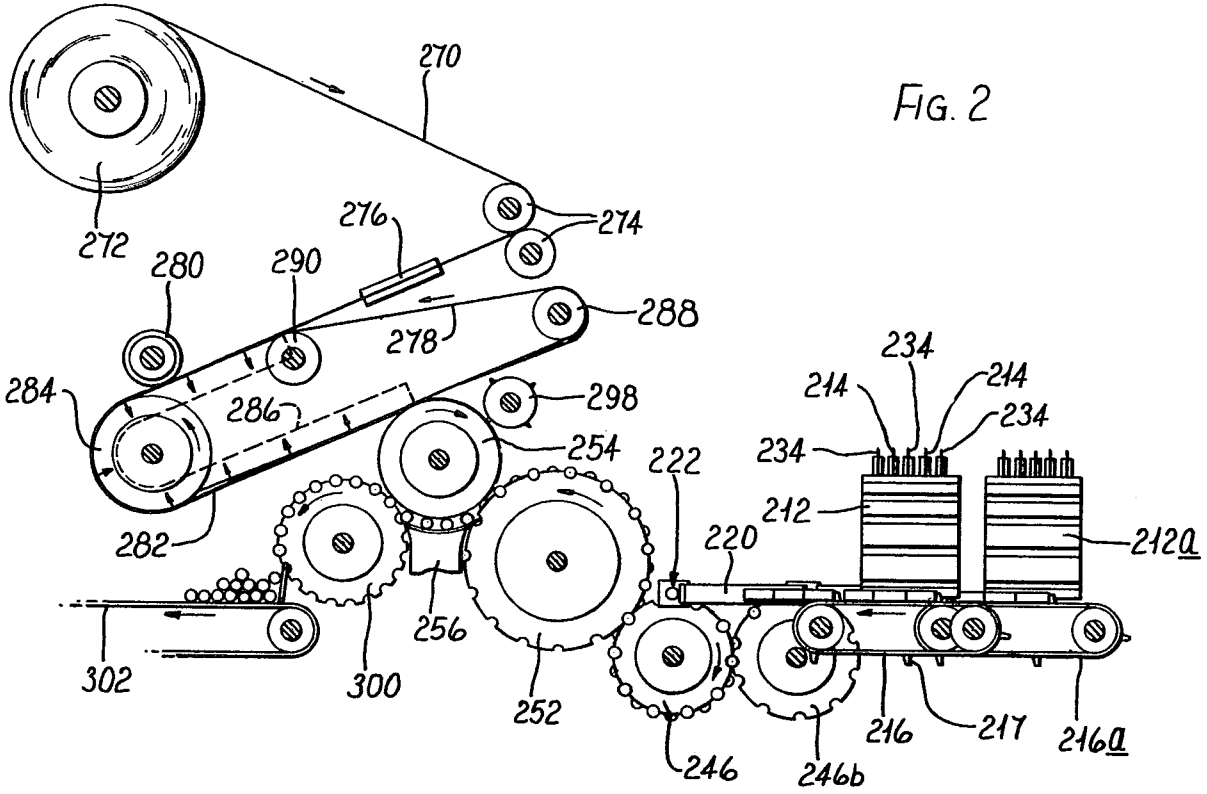
Figures 3, 4A, 4B, 5, 6, 7:
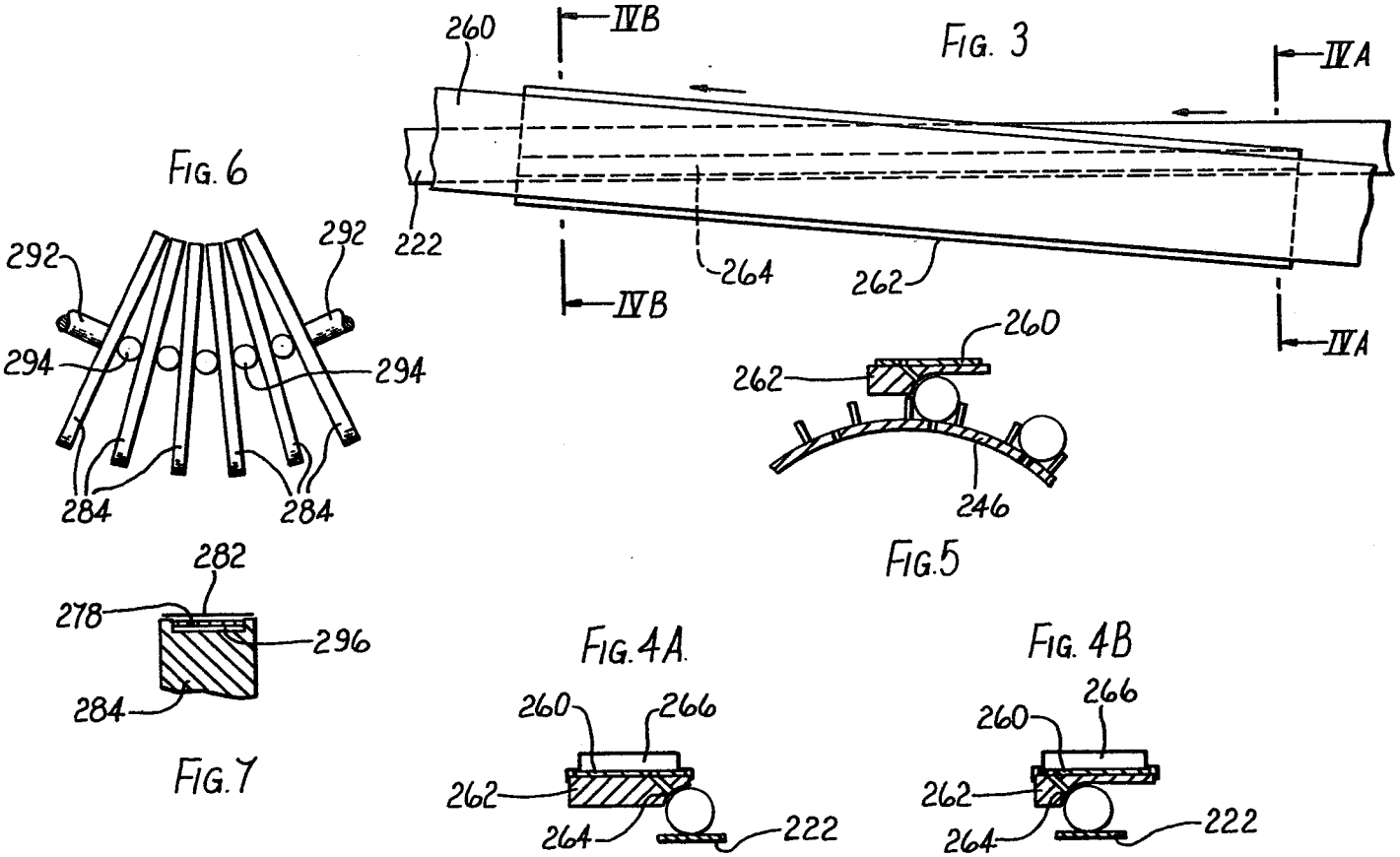
Figure 8:
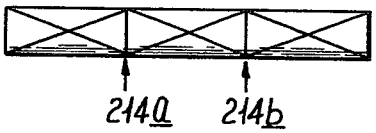
Figure 9:
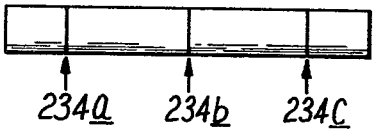
Figure 10:
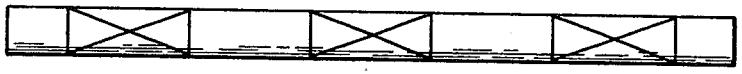
Figure 11:
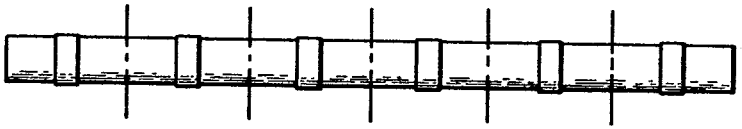

The invention will now be further described, by way of example only, with reference to the accompanying diagrammatic drawings, in which:

FIG. 1 is a plan view of apparatus for producing composite filter rods,

FIG. 2 shows the apparatus of FIG. 1, viewed from the right hand side of FIG. 1, FIG. 3 is an enlarged plan view of part of the apparatus of FIG. 1, showing a band conveyor for component filter portions, FIG. 4A is a section on the line IVA—IVA of FIG. 3, FIG. 4B is a section on the line IVB—IVB of FIG. 3, FIG. 5 is a further section through the band conveyor of FIG. 3, showing transfer of component filter portions to a fluted drum, FIG. 6 is a detail plan view of part of a set of pulleys for feeding wrapper material in the apparatus of FIG. 1, FIG. 7 is a sectional view of part of one of the pulleys of FIG. 6, FIG. 8 shows the component filter portions produced from a rod length of one type of filter material, FIG. 9 shows the component filter portions produced from a rod length of another type of filter material, FIG. 10 shows an assembled group of component filter portion for forming into a composite filter rod, and FIG. 11 shows a composite filter rod produced from the assembled components of FIG. 10.

Referring to FIGS. 1 and 2, a fluted drum 212 is arranged to receive rod lengths of a first type of filter material (e.g. fibrous cellulose acetate) from a hopper (not shown) positioned above the drum. Rotary cutting knives 214 are provided at axially spaced positions to sub-divide the rod lengths into first component filter portions as the lengths are conveyed on the drum 212. These filter portions are fed out of their flute by means of a conveyor 216 (FIG. 2) carrying pusher members 217 which pass obliquely through successive flutes so as to form a line of endwisemoving portions. The leading filter portion is pushed up out of line (by means not shown in the drawings) so as to expose its rear face for engagement by a pusher 218 carried by a rotatable disc 220. The pusher 218 accelerates the filter portion and pushes it onto a suction conveyor, the line of which is indicated at 222.

A similar arrangement is provided, downstream relative to the conveyor 222, for feeding rod lengths of a second type of filter material (e.g. myria or other paper-like material). Thus a fluted drum 232, knives 234, and conveyor 236 cooperate to supply a line of second component filter portions to a disc 240 having pushers 238 which supply the filter portions onto the suction conveyor 222.

The first and second component filter portions are fed onto the suction conveyor 222 at spaced intervals so that in general they alternate with each other and are somewhat spaced apart. The apparatus thus far described is similar to that described and illustrated in British Patent Specification No. 971,491, to which reference is directed for further details.

The division of each first rod length into component filter portions by means of knives 214*a* and 214*b* is indicated in FIG. 8. The division of each second rod length into component filter portions by means of knives 234*a*, 234*b* and 234*c* is indicated in FIG. 9. The component portions from one rod supplied to the drum 212 are intercalated with the portions obtained from a rod supplied to the drum 232 to form a group on the conveyor 222. A group in which the spaces between component portions have been closed up is shown in FIG. 10.

Each group is delivered by the suction conveyor 222 towards a series of drums which forms the group into a composite filter rod. In order that correctly formed groups are supplied by the conveyor 222 the relative timing of the delivery from the drums 212 and 232 should allow the adjacent half portions from successive rods carried by the drum 232 to be deposited on the conveyor 222 without any portion from the drum 212 occupying the space between them.

Each group is closed up into a substantially abutting line of components on the conveyor 222 by means of a spring finger which frictionally retards the filter portions on the conveyor, or by means of a cam-operated braking member such as that disclosed in British Patent Specification No. 917,701. Retarding means is indicated diagrammatically at 244.

Successive groups are transferred from the conveyor 222 to alternate flutes of a fluted catcher drum 246 by means of an angled suction conveyor 260. As shown more clearly in FIGS. 3, 4A, 4B and 5, the conveyor 260 carries a series of spaced mouldings 262 each of which has a groove 264 connected to a suction chamber 266 under which the conveyor 260 runs. The grooves 264 are inclined to the length of the conveyor 260 by such an angle that they are parallel to the conveyor 222 and are of such length that they can pick up a group from the conveyor 222 and convey it by means of suction to a position where it is transferred, again by means of suction, to the drum 246 as shown in FIG. 5. Each flute of the drum 246 which receives a group is provided with an end stop to arrest axial movement of a group supplied from the conveyor 260.

Instead of using an angled suction conveyor 260 the conveyor 222 could be extended underneath the drum 246 and this drum could be modified to operate as a catcher drum, as disclosed in British Patent Specification No. 920,409 or 1,145,274, for example.

Referring back to FIGS. 1 and 2, groups transferred to alternate flutes of the drum 246 are conveyed by suction and subsequently transferred to an end closure drum 252. The drum 252 cooperates with fixed guides which cause the components of each group to be abutted and accurately positioned relative to the axis of the drum. Thus the component filter portions are in the correct position for transfer from the drum 252 to a cooperating suction rolling drum 254 and rolling plate 256.

The groups are united into composite filter rods by the action of the rolling drum and rolling plate by rolling uniting bands around adjacent end portions of each component filter portion of a group. One uniting band may in fact span one or more component filter portions and therefore unite more than two portions of the rod but, in general, the total width of the uniting bands is less than the length of the completed filter rod. One arrangement for forming composite filter rods, in which uniting bands are obtained by severing each of a series of parallel strips of wrapping material, is disclosed in U.S. Patent Application No. 672,148. The drums 252 and 254 and the rolling plate 256 may correspond to the drums 120 and 122 and rolling plate 125 of said application.

In the arrangement shown diagrammatically in FIGS. 2, 6 and 7 of the present application a comparatively wide web of wrapper material 270 is supplied from a reel 272 to a pair of drive rollers 274. The web 270 passes through a guide 276 (which is primarily of use for threading of a new web) and onto a series of suction bands 278. The web 270 is carried on the bands 278 through rotary cutting knives 280 which divide the web into strips 282, each strip being carried by a single suction band 278. After passing the knives 280 the bands 278 pass around angled drive pulleys 284 (see FIG. 6) which space the strips 282 by the appropriate amount for the composite filter rod being produced. The bands 278 and strips 282 do not lie in a single plane after leaving the pulleys 282 but guide means are provided so that they again lie in a single plane for transfer to the strips to the suction rolling drum 254. Suction is maintained on the bands 278 in the region 286. The bands 278 return to a parallel adjacent position to support the web 270 via idler pulleys 288 and 290. The disposition of the pulley or pulleys 288 may be such that the bands 278 follow a twisting course so that they lie substantially in a single plane in the region of the drum 254.

The drive pulleys 284 are shown in FIG. 6. The end pulleys 284 are supported on shafts 292, either one of which may be the driven shaft, and the other pulleys are connected to these and interconnected by universal joints 294. In an alternative arrangement the drive for the bands 278 can be supplied through the pulley or pulleys 288 and the pulleys 284 can be freely rotatable on angled shafts. A detail view of one of the pulleys 284 is shown in FIG. 7 from which it can be seen that a suction band 278 runs in a recess 296 with the associated strip 282 of wrapping material running on the outer levels of the pulley. As noted previously the bands 278 may pass around a further set of angled pulleys at 288.

The web 270 is preferably coated with a hot melt adhesive which can be reactivated by a heater on the suction rolling drum 254. Alternatively a paster could be supplied to paste the strips 282 whilst they are supported on the bands 278.

The strips 282 are transferred from the bands 278 to the suction rolling drum 254 and are severed by means of the rotary knife 298 and spaced by the differential speed of the drum 254 and bands 278. An arrangement for uniting groups of rod-like articles in a rolling, wrapping and sealing operation is disclosed in British Patent Specification No. 886,657. Thus a series of parallel spaced uniting bands is supplied by the drum 254 to the rolling plate 256 for wrapping and sealing around the groups of component filter portions supplied by the drum 252. A composite filter rod formed by wrapping uniting bands around a group of component filter portions as shown in FIG. 10 is shown in FIG. 11.

Completed composite filter rods are transferred from the rolling plate 256 onto a further suction drum 300 which in turn supplies them to an endless band conveyor 302 for movement away from the apparatus as a continuous stack of filter rods. The rods are eventually supplied to a machine for assembling filter cigarettes where they are severed at the positions indicated by chain-dot lines in FIG. 11 and each portion so obtained placed between and united to two tobacco lengths. Individual filter cigarettes are then obtained by dividing the resulting assemblage at its mid-point.

Whilst the apparatus of FIGS. 1 and 2 so far described would operate quite satisfactorily it is preferred to double its capacity for production by providing essentially similar apparatus for assembling groups of component filter portions on a conveyor 222*a* and producing composite filter rods from these groups. Corresponding parts of this additional apparatus have been given corresponding reference numbers with a suffix *a*. It can be seen from FIG. 1, that the conveyor 260*a* is angled in the opposite direction to the conveyor 260 and supplies groups to a catcher drum 246*b* rotating in the opposite direction to drum 246. Subsequently, however, the groups are transferred to a drum 246*a* aligned with and rotating in the same direction as drum 246. The drums 246 and 246*a*, 252 and 252*a*, 254 and 254*a*, and 298 and 298*a* may be mounted on common spindles. It is preferred that groups on the drums 246 etc. should be staggered in relation to groups on the drums 246*a* etc. so that completed composite filter rods can be moved together on the single drum 300, by means of guides 304 as shown in FIG. 1.

The apparatus disclosed in said Application No. 672,148 could be used to supply assembled groups of component filter portions for uniting according to the method of the present invention.

I claim:

1. Apparatus for feeding wrapper material, comprising means for feeding a web of wrapper material, means for continuously longitudinally slitting the web into a number of strips, at least two endless bands, guide means defining paths for said bands and arranged so that the paths are adjacent in a first region and laterally spaced apart in a second region, said bands being arranged so that each strip is supported by a band between said first and second regions, and means for receiving laterally spaced strips from the bands in said second region.

2. Apparatus as claimed in claim 1 wherein said paths are substantially parallel in said first region and in said second region.

3. Apparatus as claimed in claim 1 wherein each strip is supported by a different band.

4. Apparatus as claimed in claim 3 wherein the slitting means is arranged adjacent said first region so that the web is cut into strips whilst supported by the bands.

5. Apparatus as claimed in claim 1 including drive means for the bands, to convey the strips.

6. Apparatus as claimed in claim 5 including means for applying suction through the bands to hold the strips on the bands between said first and second regions.

7. Apparatus as claimed in claim 1 wherein the guide means includes angularly-disposed pulleys arranged between said first and second regions.

8. Apparatus as claimed in claim 7 wherein the pulleys are connected by universal joints.

9. Apparatus as claimed in claim 7 wherein the pulleys are carried by separate, inclined shafts.

10. Apparatus as claimed in claim 7 wherein the bands are twisted in said second region so that they are substantially coplanar at said receiving means.

11. Apparatus as claimed in claim 1 wherein the receiving means includes at least one rotatable member and means for cutting said strips into portions on said member.

12. Apparatus as claimed in claim 11 further including means for delivering groups of axially adjacent rod-like articles to said rotatable member and for rolling said strip portions around said articles to unite said groups into composite rods.

13. Apparatus as claimed in claim 12 wherein said delivering means includes a first conveyor for moving rod-like articles in an endwise direction, a second conveyor for moving said articles in a direction transverse to their lengths, and a transfer conveyor for moving said articles from the first to the second conveyor, said transfer conveyor being arranged so that it maintains the articles parallel to their position on the first conveyor whilst moving them with a component velocity in the direction of movement of said first conveyor and with a component velocity in the direction of movement of the second conveyor.

14. Apparatus as claimed in claim 13 wherein the transfer conveyor consists of a band conveyor arranged at an angle to the direction of movement of the first conveyor, and carrier members disposed on said band conveyor at such an angle that articles conveyed by said first conveyor remain parallel to said direction of movement of the first conveyor.

* * * * *